US006566607B1

(12) United States Patent
Walling

(10) Patent No.: US 6,566,607 B1
(45) Date of Patent: May 20, 2003

(54) HIGH SPEED DATA COMMUNICATION CABLES

(75) Inventor: Jörg-Hein Walling, Beaconsfield (CA)

(73) Assignee: Nordx/CDT, Inc., Pointe-Claire (CA)

( * ) Notice: Subject to any disclaimer, the term of this patent is extended or adjusted under 35 U.S.C. 154(b) by 0 days.

(21) Appl. No.: 09/412,469

(22) Filed: Oct. 5, 1999

(51) Int. Cl.[7] ..... H01B 11/00
(52) U.S. Cl. ..... 174/113 R; 174/117 F
(58) Field of Search ..... 174/113 R, 117 F, 174/36, 27, 115, 117 R

(56) References Cited

U.S. PATENT DOCUMENTS 5,142,100 A * 8/1992 Vaupotic ..... 174/27 X
5,180,890 A * 1/1993 Pendergrass et al. .... 174/117 F
5,969,295 A * 10/1999 Boucino et al. ..... 174/113 C
6,162,992 A * 12/2000 Clark et al. ..... 174/113 R
6,248,954 B1 * 6/2001 Clark et al. ..... 174/113 R

* cited by examiner

*Primary Examiner*—Chau N. Nguyen
(74) *Attorney, Agent, or Firm*—Wolf, Greenfield & Sacks, P.C.

(57) ABSTRACT

A data communication cable includes a cable jacket surrounding a plurality of twisted pairs of insulated conductors disposed longitudinally over the length of the communication cable and arranged side-by-side to reduce cross-talk between the twisted pairs. The cable also includes a first region having a first thickness disposed between two regions having a second thickness. These regions, or another structure located on the outer surface of the jacket, are arranged to prevent symmetric stacking of several communication cables and thus reduce alien cross-talk arising from outside of the communication cable.

26 Claims, 6 Drawing Sheets

HIGH SPEED DATA COMMUNICATION CABLES

FIELD OF INVENTION

This invention relates to novel data communication cables, and more particularly to high speed data communication cables with reduced cross-talk.

BACKGROUND

Over the last decade, the deployment of computer networks has steadily increased, which in turn increased the demand for data communication cables. The performance requirements imposed on new communication cables also increased steadily with the development of new network architectures. Initially, conventional telephone-grade cables were used for voice transmission and for low speed data transmission in the range of a few megabits per second. Unshielded twisted pairs have been used to transmit data in local area networks (LANs). However, such cables were inadequate for high speed transmissions. Therefore, new types of data cables have been developed and introduced.

Present network architectures, such as 100Base-T and 1000Base-T, require high speed communication cables with low attenuation, acceptable return loss, low crosstalk and good electromagnetic compatibility (EMC) performance. These parameters ensure a substantially bit-error free data transmission. Modern high speed data grade cables utilize twisted pairs of insulated conductors. These cables must meet specific requirements with respect to attenuation, cross-talk, impedance, return loss, delay, delay skew and balance. The available performance margin for a data grade cable is indicated by its attenuation to crosstalk ratio (ACR) and equal level far end cross-talk (EL FEXT). ACR is calculated by subtracting the attenuation of the disturbing pair from the near-end cross-talk (NEXT) in dB. EL FEXT on the far side is calculated by subtracting the attenuation of the disturbing pair from the far-end cross-talk (FEXT). The cross-talk depends inversely on the square of the distance of the twisted pairs.

Modern network architectures use simultaneous transmission of data over several twisted pairs, and may even use 1000Base-T simultaneous, bi-directional transmission over four pairs of one cable. Thus data communication cables used for these protocols have to have very good NEXT and FEXT performance. The required performance is so high, that crosstalk arising from adjacent cables may become detrimental to the high speed data transmission. Such a crosstalk is referred to as alien crosstalk, since it is generated by alien influences outside the considered cable.

The near-end cross-talk in one twisted pair arises from the neighboring "disturbing" pairs inside the same cable. This coupling is inversely proportional to the square of the distance of the centerline of the disturbed and disturbing twisted pairs. Round cables with several twisted pairs have a varying distance between the pairs with the same twistlay. This variation occurs since the mean center to center distance, between pairs with substantially equal twistlay, is in the order of the diameter of the cable. Hence, the crosstalk between such pairs is relatively weak, despite the fact that one should expect relatively poor crosstalk performance due to the same twistlay length.

There is a way to compensate for the cross-talk coupled within the same cable because the coupling is common mode. Since the two conductors of each twisted pair carry complementary signals, the cross-talk coupled within the same cable can be compensated by adaptive amplifier techniques. However, the alien cross-talk, coupled from the outside of the cable into a twisted pair, is statistical and thus cannot be compensated for.

Therefore, there is still a need for high speed data communication cables with very low cross-talk arising from neighboring pairs of twisted conductors and cables with very low alien cross-talk.

SUMMARY

The present invention is directed to high speed data communication cables with optimal cross-talk performances. According to one aspect, a data communication cable includes a cable jacket surrounding a plurality of twisted pairs of insulated conductors disposed over a length of the communication cable in an arrangement that reduces cross-talk between the twisted pairs. The cable also includes a first region having a first thickness disposed between two regions having a second thickness.

According to another aspect, a data communication cable includes a cable jacket surrounding a plurality twisted pairs of insulated conductors extending side-by-side over a length of the cable with the adjacent twisted pairs having different non-parallel lays. The cable assembly has a non-uniform outer width dimension that precludes aligned stacking of a plurality of the cable assemblies.

According to another aspect, a data communication cable includes several twisted pairs of insulated conductors arranged side-by-side, and a cable jacket surrounding the twisted pairs and having a substantially flat profile. A structure located on the outer surface of the jacket is arranged to prevent symmetric stacking of several communication cables with such substantially flat profile thereby reducing alien cross-talk arising from outside of the communication cable. The structure may have a rectangular, trigonal, oval shape (or a similar shape) and may be located outside of the cable jacket over the entire length of the cable.

Preferred embodiments of these aspects include one or more of the following features.

The communication cable may have a profile with regions of two thicknesses wherein the first thickness is less than the second thickness. Alternatively, the first thickness may be greater than the second thickness. The first region may be substantially flat. The communication cable may have two regions of the second thickness and these regions may have a semi-circular cross-section. Alternatively, the two regions of the second thickness may have a substantially flat cross-section. The two regions of the second thickness may have a substantially polygon-shaped cross-section.

The communication cable may include sheathing elements each surrounding the twisted pair of insulted conductors. The sheathing element may be made of a dielectric material or a conducting material. The conducting material may be a conducting foil or another metallic material.

The communication cable further includes a plurality of inwardly extending fins that are at least partially disposed between the individual twisted pairs. The fins may form a plurality of channels, wherein each channel is arranged to receive one twisted pair of insulated conductors. The fins may form an integral part of the cable jacket.

Advantageously, the novel communication cable achieves very high cross-talk performance by providing an essentially flat cable design, which has reduced cross-talk resulting from the side-by-side position of its twisted pairs, and includes novel structures formed on the outer periphery of the cable jacket. The novel structures prevent completely random stacking of the cables or increase the average pair to pair distance of pairs with the same twist lay. When the novel cables are located together in a tray, conduit, trough or plenum, the jacket structures also prevent parallel, uniform stacking of the cables and thus prevent alignment of twisted pairs with same twist lay.

DETAIL DESCRIPTION

Figure 1:
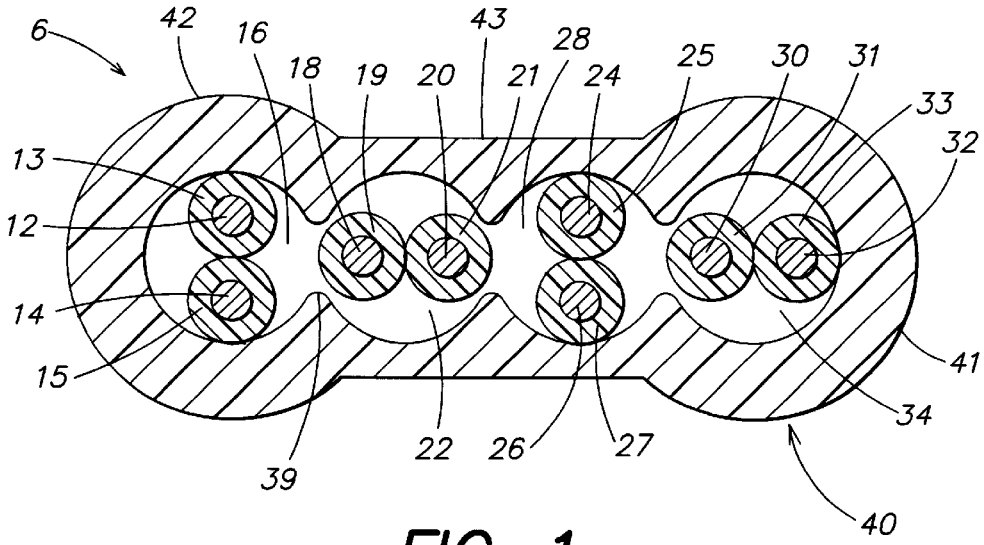
FIGS. 1, 2 and 3 are cross-sectional views of high speed data communication cables including a cable jacket with three regions of varying thickness arranged to reduce alien crosstalk.

Referring to FIG. 1, a high speed data communication cable 6 includes four twisted pairs of insulated conductors disposed longitudinally along the communication cable. Metal conductors 12, 14, 18, 20, 24, 26, 30, and 32 are surrounded by insulation sleeves 13, 15, 19, 21, 25, 27, 31 and 33 along their entire length. The neighboring wires 12 and 14, with their respective sleeves 13 and 15, form one twisted pair. Similarly, wires 18 and 20, with their respective sleeves 19 and 21, form another twisted pair, etc. The twisted pairs are located in longitudinal channels 16, 22, 28, and 34 (which may be filled with a dielectric material). As shown in cross-section in FIG. 1, each twisted pair is oriented differently relative to the neighboring twisted pair to reduce near-end cross-talk. The twisted pairs of the individually insulated conductors are arranged together with a twist length (called "twist lay") of between 0.25 and 1.0 inches, and each pair may have a left twist direction or a right twist direction. The twisted pairs are surrounded by a cable jacket 40. Instead of locating each twisted pairs in a hollow longitudinal channel, the twisted pair may be surrounded by a dielectric material.

Insulating layers 13, 15, 19, 21, 25, 27, 31 and 33 are made of a low loss dielectric material, such as for instance polyethylene or fluoropolymer. The insulating material may also be foamed or made from multilayer insulations. Cable jacket 40 is preferably made of polyvinylchloride or fluoropolymers. Cable jacket 40 provides dimensional stability and precise positioning of the twisted pairs of insulated conductors. Longitudinal channels 16, 22, 28, and 34 provide substantially constant distance between the twisted pairs along the entire length of the cable also during bending of the cable in use. Thus, even under different tensions and bend radii applied to cable 6, the capacitance and inductance imbalances are reduced. Cable jacket 40 includes regions 41 and 42 having a larger thickness than a region 43; jacket regions 41, 42 and 43 are arranged to prevent symmetric stacking of adjacent communication cables.

Preferably, metal conductors 12, 14, 18, 20, 24, 26, 30 and 32 are made from 22 to 24 gauge copper wire, and insulation sleeves 13, 15, 19, 21, 25, 27, 31 and 33 have a thickness in the range of 5 mils to 10 mils. Cable jacket 40 has a thickness in the range of 10 mils to 25 mils, wherein regions 41 and 42 have about 50% to 100% larger thickness than region 43.

Data communication cable 6 can include the twisted pairs with the same twist lay and possibly the same twist direction, or at least some of the twisted pairs may have a different twist lay and the same twist direction. If some of the twisted pairs have different twist lays from the other twisted pairs, the thickness of insulation sleeves 13, 15, 19, 21, 25, 27, 31 and 33 is selected to produce twisted pairs with substantially similar electrical characteristics. The insulation thicknesses of sleeves 13, 15, 19, 21, 25, 27, 31 and 33 are matched to the twist lays in order to provide, for each twisted pair, a nominal characteristic impedance that is within the normal commercial range. Thus, the twisted pairs with smaller twist lays have thicker insulations than the twisted pairs with larger twist lays. This way the impedance and signal attenuation of the twisted pair are within acceptable limits. Depending on the performance requirements, the distances between the wires can be calculated for any particular wire gage (AWG) of the conductors based on known mathematical models.

To reduce the effect of alien cross-talk, a high speed data communication cable can include various structures. As shown in FIG. 1, data communication cable 6 includes cable jacket 40 having a bone shaped cross-section. Specifically, two regions 41 and 42 have a semi-circular cross-section having a larger thickness then a region 43, which is substantially flat. This structure increases the center-to-center distance between identical twisted pairs similarly positioned in the neighboring cables when stacked in alignment. Alternatively, this structure achieves a misalignment by shape induced sideways shifting of one cable relative to another. That is, the bone shaped profile of cable jacket 40 prevents the possibility of positioning twisted pairs of the same twist lay very close together.

The shape of cable jacket 40 prevents symmetric stacking of flat data communication cables, when such cables are installed in ducts, troughs, and locations close to the cross-connect panels. Otherwise, the flat cables may automatically arrange, align and stack themselves in near perfect alignment due to their flat or rectangular shape. Such arrangement would yield a high alien cross-talk coupling. Alien cross-talk coupling, from the outside of the cable into the twisted pairs, is statistical and cannot be compensated for by adaptive amplifier techniques. Alien cross-talk would be enhanced by the fact that the location of the twisted pairs within a flat cable jacket is parallel and the twisted pairs with the same twist lays or directions would be frequently separated only by the jacket material surrounding each cable.

Figure 2:
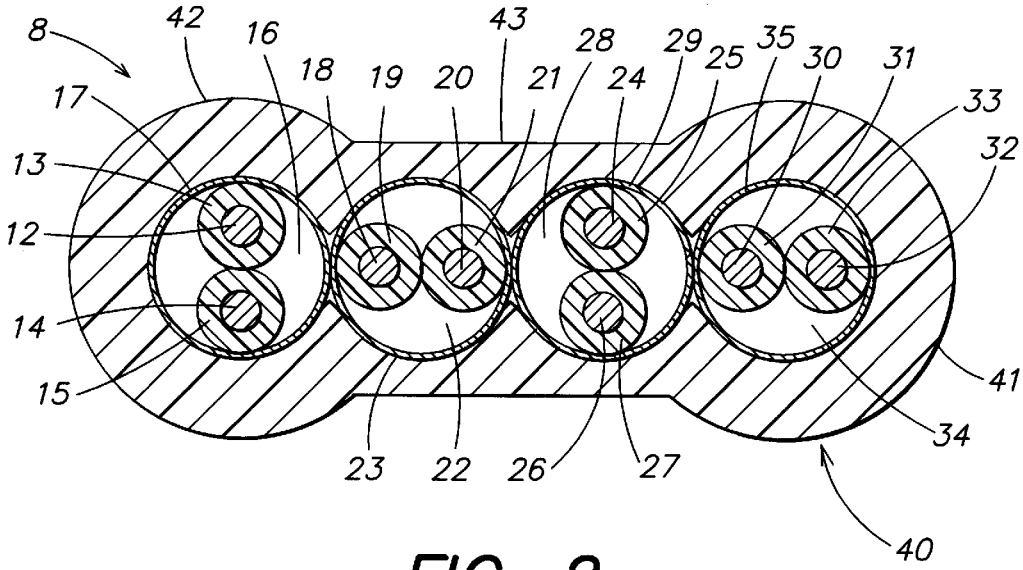

Referring to FIG. 2, a high speed data communication cable 8 also includes, for example, four twisted pairs having copper conductors 12, 14, 18, 20, 24, 26, 30, and 32 surrounded by insulation sleeves 13, 15, 19, 21, 25, 27, 31 and 33, respectively. Each twisted pair is oriented differently relative to the neighboring twisted pair, and the twisted pairs are surrounded by dielectric material 16, 22, 28, and 34. To reduce near-end cross-talk, dielectric material 16, 22, 28, and 34 are surrounded by conductive shields 17, 23, 29, and 35, respectively. Similarly as for data communication cable 6, data communication cable 8 includes cable jacket 40 with the bone shaped cross-section having semi-circular regions 41 and 42 and a flat region 43.

Figure 3:
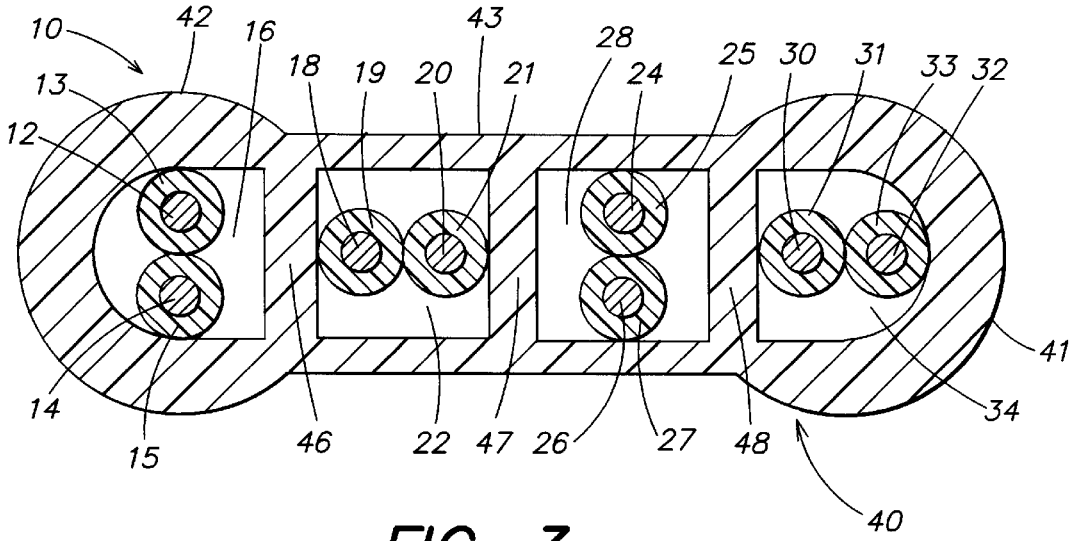

FIG. 3 shows another high speed data communication cable 10, which is similar to data communication cables 6 and 8. Data communication cable 10 includes four twisted pairs having copper conductors 12, 14, 18, 20, 24, 26, 30, and 32 surrounded by insulation sleeves 13, 15, 19, 21, 25, 27, 31 and 33, respectively. Again, each twisted pair is oriented differently relative to the neighboring twisted pair. To reduce losses, the twisted pairs are surrounded by dielectric regions 16, 22, 28, and 34. To reduce the cross-talk coupling and EMI, dielectric regions 16, 22, 28, and 34 are separated by respective fins 46, 47, and 48, which are made together with cable jacket 40. Similarly as for data communication cables 6 and 8, data communication cable 10 includes cable jacket 40 with the bone shaped cross-section having semi-circular regions 41 and 42 and flat region 43.

Figure 1A:
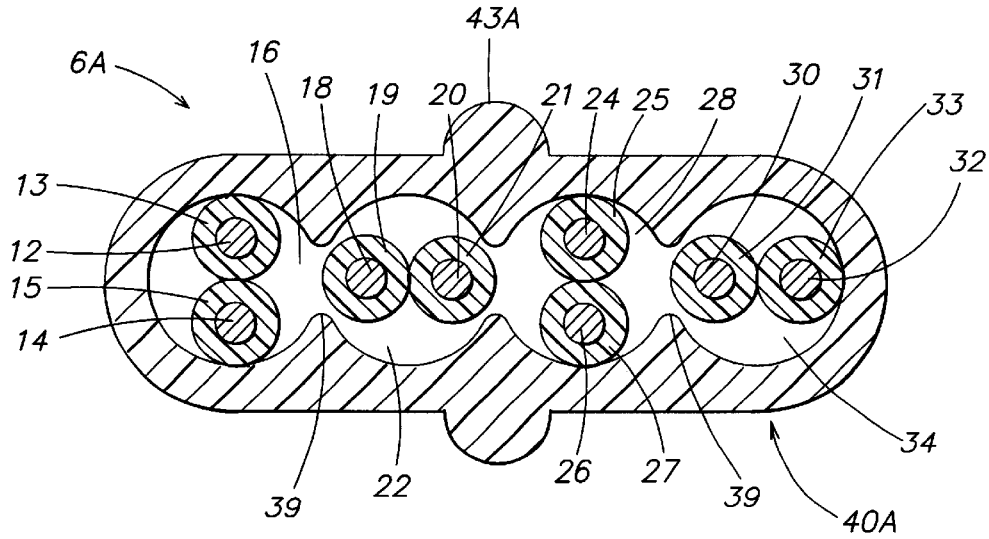
FIGS. 1A, 2A and 3A are cross-sectional views of high speed data communication cables including a cable jacket with a central structure arranged to reduce alien cross-talk.
Figure 1B:
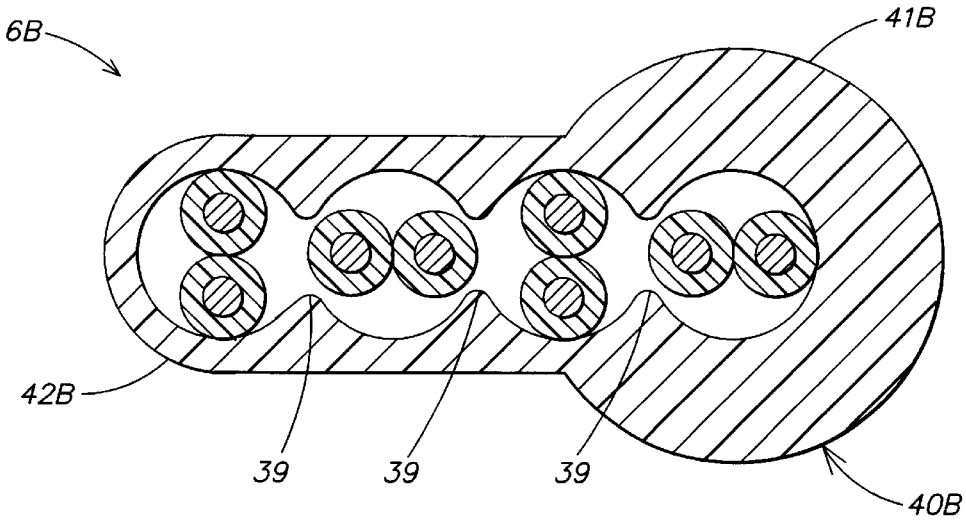
FIGS. 1B, 2B and 3B are cross-sectional views of high speed data communication cables including a jacket having non-uniform thickness arranged to reduce alien cross-talk.
Figure 1C:
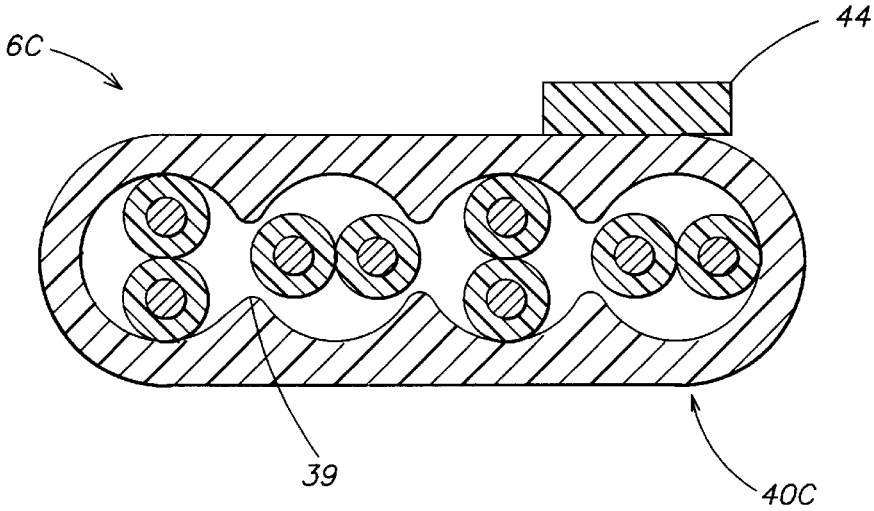
FIGS. 1C, 2C and 3C are cross-sectional views of high speed data communication cables including a structure for reducing alien cross-talk.

FIGS. 1A through 3C depict high speed data communication cables 6A through 10C having different structures for reducing alien cross-talk. Referring to FIGS. 1A through 1C, data communication cables 6A, 6B and 6C have the same twisted pair design as data communication cable 6. However, the data communication cables differ in the geometrical structures that are designed to reduce alien cross-talk. Data communication cable 6A includes a cable jacket 40A with two oppositely located protruding regions 43A made by increasing the thickness of cable jacket 40 in the center region. When two data communication cables 6A are located on top of each other, protruding regions 43A cause sideways shifting of the two cables and thus a misalignment of the twisted pairs with the same twist lays. Thus, protruding regions 43A reduce alien cross-talk.

FIGS. 1B and 1C are cross-sectional views of communication cables 6B and 6C, respectively, which includes the same arrangement of twisted pairs as FIGS. 1 and 1A. For simplicity, in FIGS. 1B and 1C the twisted pair wires and their insulations are not labeled with the reference numerals, and the reader is referred to FIGS. 1 and 1A. Similarly, FIGS. 2B, 2C, 3B and 3C do not include the reference numerals. Referring now to FIG. 1B, data communication cable 6B includes a cable jacket 40B having an end region 41B of a much larger thickness than the thickness of an end region 42B. The shape of end region 41B prevents symmetric stacking of two aligned communication cables 6B. The shape of end region 41B may also be designed to prevent stacking of two communication cables 6B rotated 180° relative to each other. Referring to FIG. 1C, data communication cable 6C includes a cable jacket 40C designed to have a substantially uniform flat cross-section, and a structure 44 attached to cable jacket 40C. Structure 44 misaligns two neighboring data communication cables when placed into a duct or trough. Furthermore, structure 44 enables easy identification of the individual twisted pairs along data communication cable 6C.

Figure 2A:
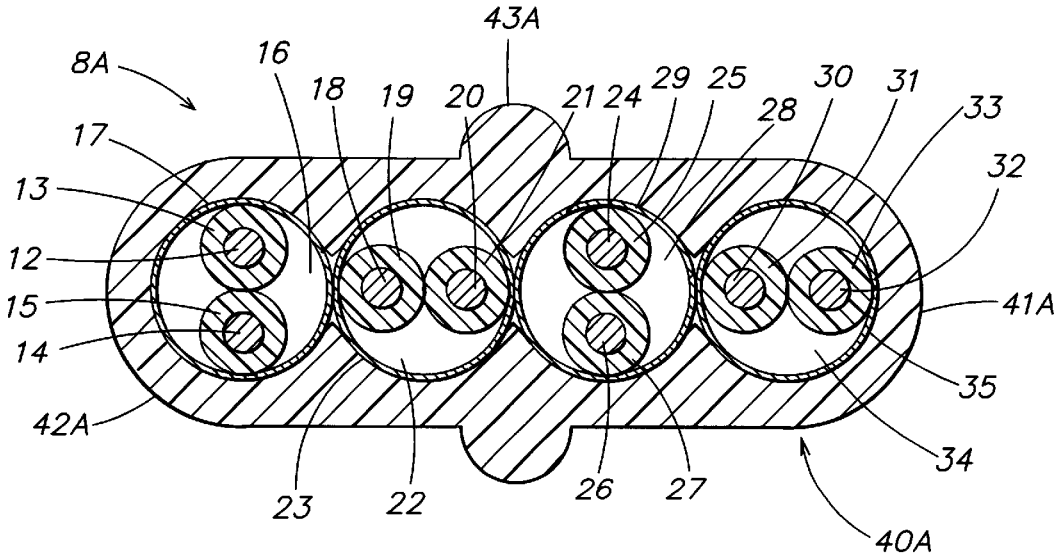
Figure 2B:
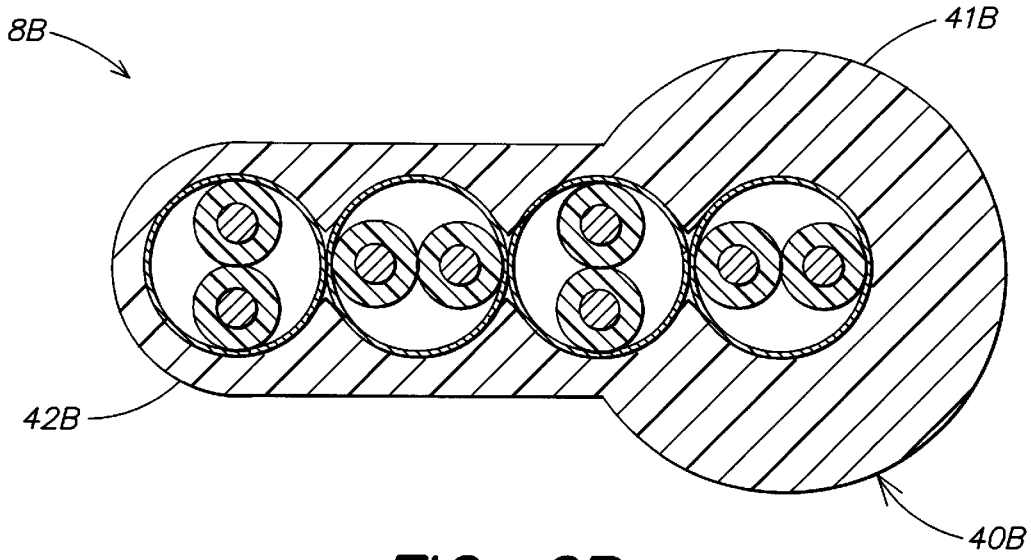
Figure 2C:
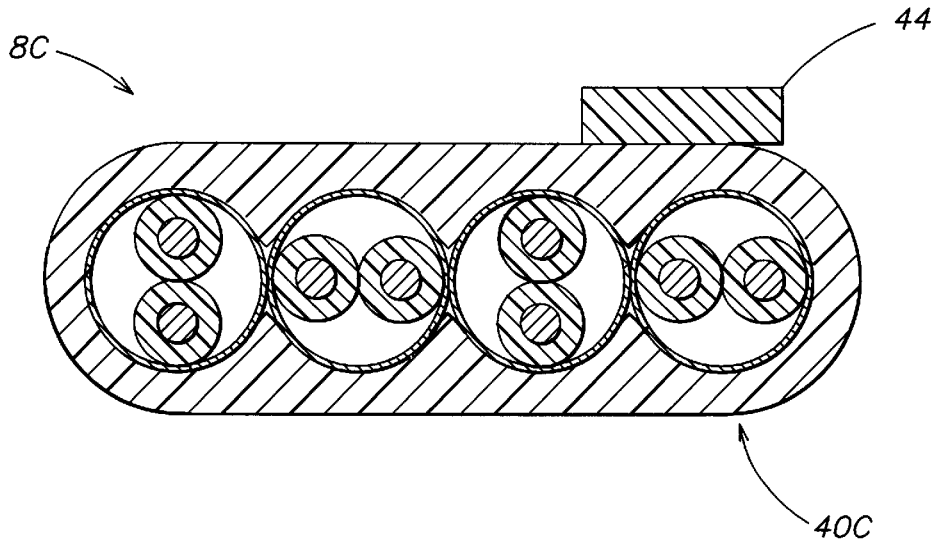

Referring to FIGS. 2A through 2C, data communication cables 8A, 8B and 8C have the same twisted pair design as data communication cable 8. They include copper conductors 12, 14, 18, 20, 24, 26, 30 and 32, insulation sleeves 13, 15, 19, 21, 25, 27, 31 and 33, and conductive shields 17, 23, 29, and 35 designed to reduce cross-talk. (For simplicity, only FIGS. 2 and 2A include the reference numerals.) However, cables 8A, 8B and 8C again differ in the geometrical structure for reducing alien cross-talk. These structures are similar to the structures used in data communication cables 6A, 6B and 6C. Referring to FIG. 2A, data communication cable 8A includes cable jacket 40A with two opposite protruding regions 43A made by increasing the thickness of cable jacket 40 in the center along the cable length.

Referring to FIG. 2B, data communication cable 8B includes cable jacket 40B having end region 41B, described in connection with FIG. 1B, along its entire cable length. As shown in FIG. 2C, data communication cable 8C includes a cable jacket 40C, which has a substantially uniform cross-section and structure 44, described in connection with FIG. 1C. Structure 44 is added to cable jacket 40C along the cable length to misalign or shift sideways neighboring data communication cables when placed next to each other and thus prevent symmetrical stacking. In another embodiment, the shape of structure 44 may also prevent symmetrical stacking of two communication cables 8C rotated 180° with respect to each other.

Figure 3A:
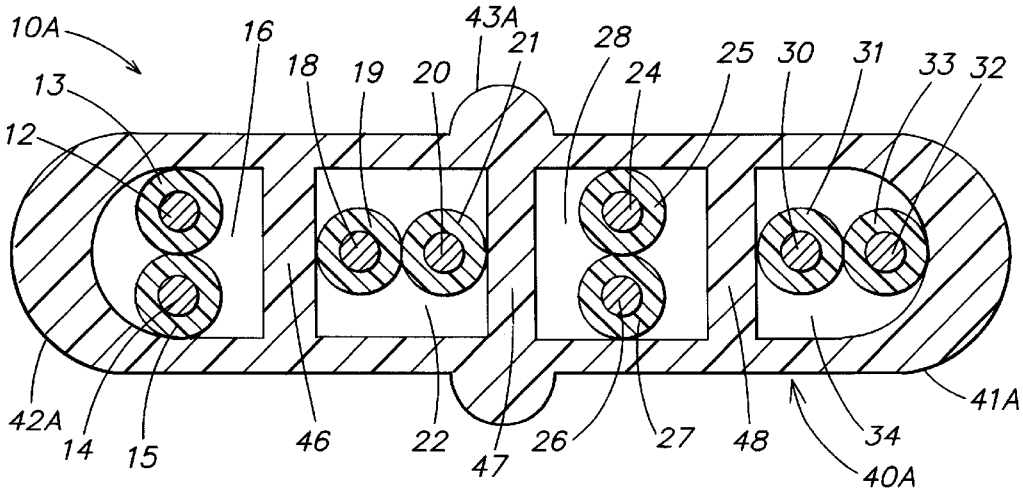
Figure 3B:
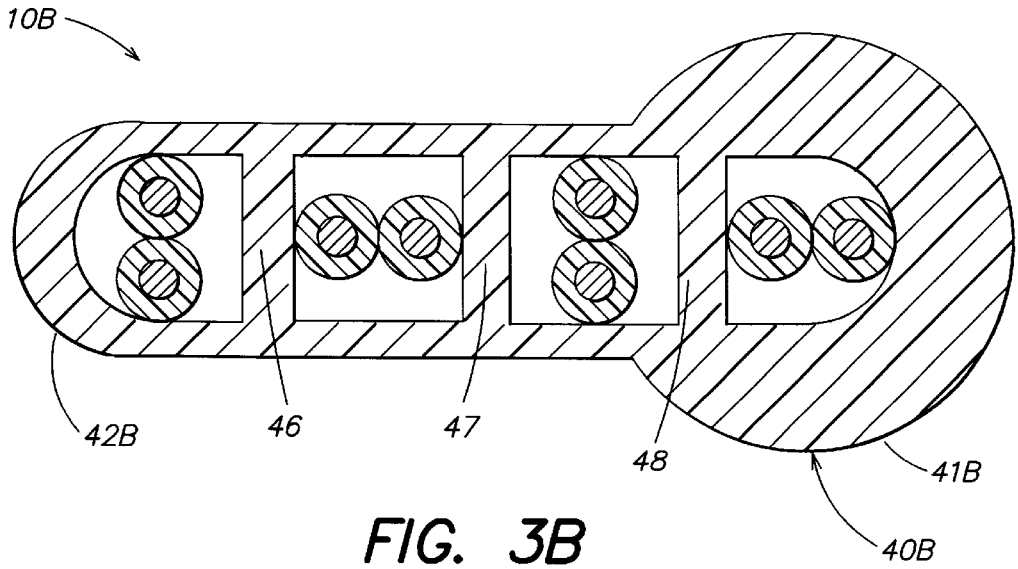
Figure 3C:
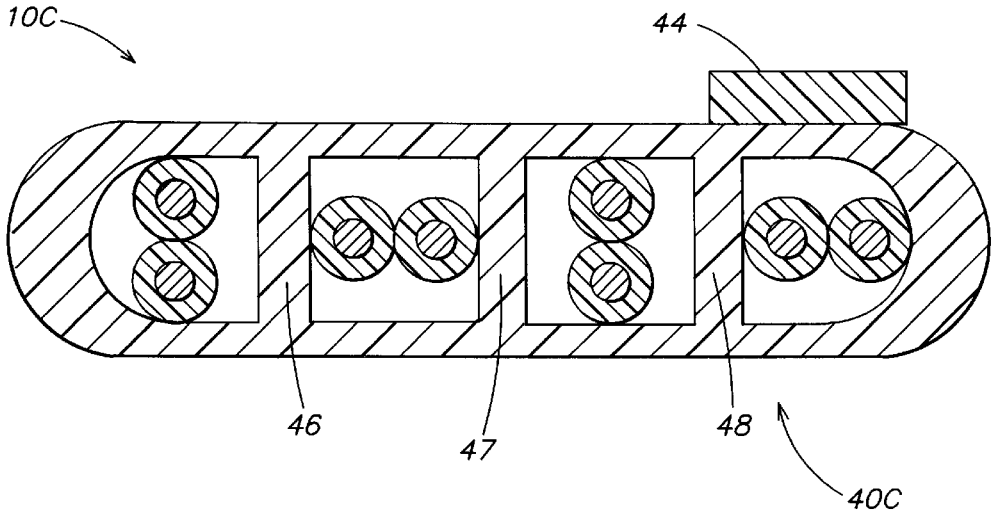

Referring to FIGS. 3A through 3C, similarly as above, data communication cables 10A, 10B and 10C have the same design of the individual twisted pairs as data communication cable 10. As described in connection with FIG. 3, cables 10A, 10B and 10C includes eight copper conductors surrounded by the insulation sleeves and the dielectric regions. The dielectric regions are separated by fins 46, 47, and 48. The individual data communication cables 10A, 10B and 10C differ in the geometrical formations that reduce alien cross-talk. These formations are similar to the ones used in data communication cables 8A, 8B and 8C. Referring to FIG. 3A, data communication cable 8A includes cable jacket 40A with two protruding regions 43A. Data communication cable 8B, shown in FIG. 3B, includes cable jacket 40B with end region 41B having a much larger thickness than the thickness of end region 42B. Referring to FIG. 3C, data communication cable 8C includes cable jacket 40C, which has a substantially uniform cross-section and includes a structure 44. Structure 44 is added to cable jacket 40C in order to misalign or shift sideways the neighboring data communication cables and thus prevent symmetrical stacking.

Additional embodiments are within the following claims:

1. A data communication cable comprising:

a cable jacket surrounding a plurality of twisted pairs of insulated conductors disposed longitudinally over a length of the communication cable holding said twisted pairs in a substantially constant geometric relationship and side-by side location, thereby reducing cross-talk between said twisted pairs; and said cable jacket including a first region having a first thickness disposed between two regions having a second thickness defining an uneven external cross-sectional shape of the data communication cable which prevents aligned stacking of the data communication cable, thereby reducing alien crosstalk.

2. The data communication cable of claim 1 wherein said first thickness is less than said second thickness.

3. The data communication cable of claim 1 wherein said first thickness is greater than said second thickness.

4. The data communication cable of claim 1 wherein each said twisted pair includes an individual sheathing layer surrounding said pair of insulated conductors.

5. The data communication cable of claim 4 wherein said sheathing layer is made of a dielectric material.

6. The data communication cable of claim 4 wherein said sheathing layer is made of a conducting material.

7. The data communication cable of claim 6 wherein said conducting material is a conducting foil.

8. The data communication cable of claim 1 wherein said cable jacket further includes a plurality of inwardly extending fins at least partially disposed between said twisted pairs.

9. The data communication cable of claim 8 wherein said fins form a plurality of channels, each said channel being arranged to receive one of said twisted pairs.

10. The data communication cable of claim 1 wherein said first region is substantially flat.

11. The data communication cable of claim 1 wherein said two regions of said second thickness have a substantially semicircular cross-section.

12. The data communication cable of claim 1 wherein said two regions of said second thickness have a substantially flat cross-section.

13. The data communication cable of claim 1 wherein said two regions of said second thickness have a substantially polygons-shaped cross-section.

14. A data communication cable assembly comprising a cable jacket surrounding a plurality of twisted pairs of insulated conductors extending side-by-side over a length of the cable with the adjacent twisted pairs having different non-parallel lays, said cable assembly having a non-uniform outer width dimension to preclude aligned stacking of a plurality of said cable assemblies.

15. The data communication cable of claim 14 wherein each said twisted pair includes an individual sheathing layer surrounding said pair of insulated conductors.

16. The data communication cable of claim 15 wherein said sheathing layer is made of a dielectric material.

17. The data communication cable of claim 15 wherein said sheathing layer is made of a conducting material.

18. The data communication cable of claim 17 wherein said conducting material is a conducting foil.

19. The data communication cable of claim 14 wherein said cable jacket further includes a plurality of inwardly extending fins at least partially disposed between said twisted pairs.

20. The data communication cable of claim 19 wherein said fins form a plurality of channels, each said channel being arranged to receive one of said twisted pairs of insulated conductors.

21. The data communication cable of claim 14 wherein said non-uniform outer width dimension includes at least two regions of said cable jacket having different thicknesses.

22. The data communication cable of claim 21 wherein a first region of said at least two regions is substantially flat.

23. The data communication cable of claim 21 wherein said at least two regions include a first region of a first thickness and two regions of a second thickness.

24. The data communication cable of claim 23 wherein said two regions of said second thickness have a substantially semicircular cross-section.

25. The data communication cable of claim 23 wherein said two regions of said second thickness have a substantially polygons-shaped cross-section.

26. A high speed communication cable including:

several twisted pairs of insulated conductors disposed side-by-side and surrounded by a cable jacket;

means for reducing cross-talk between said twisted pairs of insulated conductors located within the cable; and means for reducing alien cross-talk arising from a twisted pair located outside the cable;

wherein said means for reducing alien cross-talk includes means for preventing a completely random relative orientation of several communication cables located in a conduit.

* * * * *